US008437653B2

(12) United States Patent
Brown et al.

(10) Patent No.: US 8,437,653 B2
(45) Date of Patent: May 7, 2013

(54) SYSTEM FOR COOLING A DEVELOPER ROLL INSIDE AN IMAGE FORMING DEVICE

(75) Inventors: Stephen Andrew Brown, Lexington, KY (US); Benjamin Charles DeVore, Lexington, KY (US); Nicholas Fenley Gibson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 544 days.

(21) Appl. No.: 12/709,233

(22) Filed: Feb. 19, 2010

(65) Prior Publication Data

US 2011/0206408 A1 Aug. 25, 2011

(51) Int. Cl.
*G03G 21/20* (2006.01)

(52) U.S. Cl.
USPC ..... 399/92

(58) Field of Classification Search ..... 399/92
See application file for complete search history.

(56) References Cited

U.S. PATENT DOCUMENTS 5,166,727 A * 11/1992 Miyamoto et al. ..... 399/92
5,612,768 A * 3/1997 Kim et al. ..... 399/92
2009/0202270 A1* 8/2009 Brown et al. ..... 399/92

* cited by examiner

*Primary Examiner* — Walter L Lindsay, Jr.
*Assistant Examiner* — Ruth Labombard

(57) ABSTRACT

A system for cooling a developer roll inside an image forming device. In one embodiment of the invention, the system for cooling the developer roll includes an air duct for carrying an airflow, the air duct having at least one opening to allow airflow to pass therethrough, and at least one toner cartridge in fluid communication with the air duct. The at least one toner cartridge includes the developer roll and at least one input port. The at least one input port is coupled to the at least one opening of the air duct to receive the airflow and to direct the received airflow towards end portions of the developer roll via a conduit and nozzles located within the toner cartridge. The system provides an effective way for introducing the airflow into the toner cartridge for cooling the developer roll.

15 Claims, 3 Drawing Sheets

SYSTEM FOR COOLING A DEVELOPER ROLL INSIDE AN IMAGE FORMING DEVICE

BACKGROUND

1. Field of the Invention

The present invention relates to a system for cooling a developer roll inside an image forming device.

2. Description of the Related Art

An image forming device, such as a laser printer, forms a latent image on a surface of a photoconductive drum by selectively exposing an area of the surface to light. Generally, the photoconductive drum is made of photoconductive material that is discharged by light, typically emitted by a laser. As the photoconductive drum rotates, the image forming device directs a laser beam across the surface of the photoconductive drum to discharge certain points. The laser beam "draws" letters and images to be printed as a pattern of electrical charges—the latent image. The latent image is developed into a visible or a toned image by using toner.

The toner is stored in a toner cartridge housing, a small container built into a removable casing. The image forming device gathers the toner from a sump within the toner cartridge housing and supplies it to a developer roll. The developer roll is a charged rotating roller. The toner moves from the developer roll onto the latent image on the photoconductive drum to create the toned image on the photoconductive drum. The toner cartridge housing is generally sealed to prevent toner leakage. Usually, J-seals are positioned proximate both ends of the developer roll to seal the toner cartridge housing on one hand and the developer roll on the other.

However, there is friction between the developer roll and the J-seals when the developer roll rotates. The friction creates heat inside the toner cartridge. Printing at higher speeds such as at or above 50 ppm causes extreme overheating, which is localized at the ends of the developer roll around the J-seals interface. Due to overheating, the toner leaks out through the J-seals. Once toner leakage at the J-seals begins, toner loss usually continues at a rapid rate, permitting several grams of toner per minute to escape into the image forming device. Such large amounts of toner losses severely affect cartridge yield, and may result in yields of several thousand pages fewer than expected. In addition, major print defects occur as the escaped toner from the toner cartridge can spill directly onto a transfer belt near the location of a first transfer or onto print media.

One solution to prevent overheating of the developer roll is to apply a lubricant to the ends of the developer roll or to the J seals to decrease the coefficient of friction. However, the lubricant applied to the J-seals or to the ends of the developer roll may contaminate the toner and ruin any printed image. Additionally, the lubricant may seep into other areas of the toner cartridge or the image forming device, causing unwanted damage and interfere with the proper operation of the unit. Another solution to prevent overheating of the developer roll is to utilize directed airflow, such as from a fan, to blow air across the entire length of the developer roll. However, this had been found to be ineffective in lowering the temperature of the developer roll by any significant amount.

It would therefore be desirable to provide an effective cooling system that obviates the above-mentioned problems.

SUMMARY OF THE INVENTION

Disclosed herein is a system for cooling a developer roll inside an image forming device. The system includes an air duct for carrying an airflow, the air duct having at least one opening to allow airflow to pass therethrough, and at least one toner cartridge in fluid communication with the air duct, the at least one toner cartridge includes the developer roll and at least one input port disposed adjacent the developer roll, the at least one input port coupled to the at least one opening of the air duct to receive the airflow and to direct the received airflow towards the developer roll.

In some embodiments, the air duct is disposed on an inside surface of a front cover of the image forming device.

In some embodiments, the system further includes a waste toner box positioned between the air duct and the at least one toner cartridge, the waste toner box includes a channel connecting the at least one opening of the air duct to the at least one input port of the at least one toner cartridge.

In some embodiments, the waste toner box channel includes a first end coupled to the opening of the air duct and a second end coupled to the at least one input port of the at least one toner cartridge, and the coupling is provided through a sealing member.

In some embodiments, the at least one toner cartridge further includes an air conduit, the air conduit includes an elongated body having a length extending between a first end and a second end, the first end being coupled to the at least one input port for receiving the airflow and a pair of nozzles disposed along the elongated body, one of the pair of nozzles positioned to direct the received airflow at a distal end of the developer roll and the other of the pair of nozzles is positioned to direct the received airflow at a proximal end of the developer roll.

In some embodiments, the at least one opening of the air duct is coupled to the at least one input port of the toner cartridge through a seal member.

In another aspect, an image forming device includes a housing, an air duct disposed within the housing for carrying an airflow, the air duct having at least one opening to allow airflow to pass therethrough, and at least one toner cartridge in fluid communication with the air duct, the at least one toner cartridge includes a developer roll and at least one input port coupled to the at least one opening of the air duct to receive the airflow and to direct the received airflow towards the developer roll.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention and are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and together with the description serve to explain the principles and operation of the invention.

BRIEF DESCRIPTION OF THE DRAWINGS

The above-mentioned and other features and advantages of the various embodiments of the invention, and the manner of attaining them, will become more apparent will be better understood by reference to the accompanying drawings, wherein.

DETAILED DESCRIPTION

Figure 1:
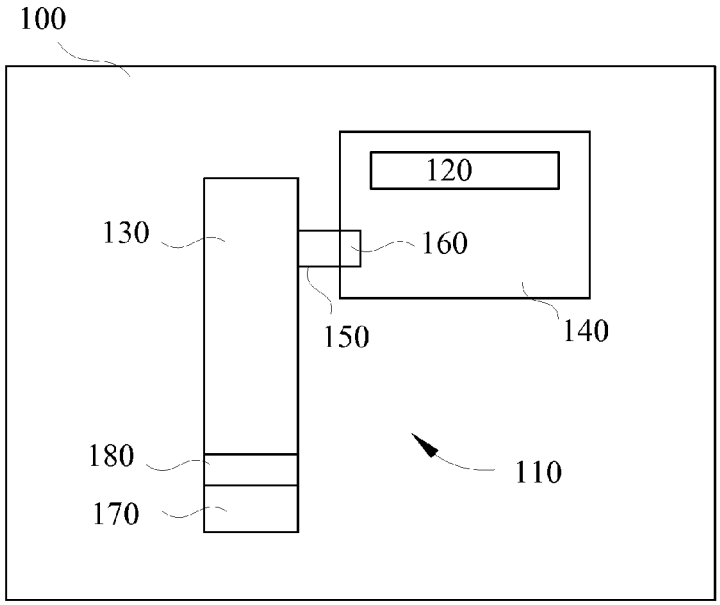
FIG. 1 is a block diagram of an exemplary embodiment of a system for cooling a developer roll of a toner cartridge inside an image forming device according to the present invention.

Reference will now be made in detail to the exemplary embodiment(s) of the invention, examples of which are illustrated in the accompanying drawings. Whenever possible, the same reference numerals will be used throughout the drawings to refer to the same or like parts.

FIG. 1 illustrates one embodiment of a system 110 for cooling a developer roll 120 inside an image forming device 100 according to the present invention. The system 110 includes an air duct 130 and a toner cartridge 140. The air duct 130 is in fluid communication with the toner cartridge 140. While only one toner cartridge is illustrated, there may be multiple toner cartridges connected to air duct 130. The air duct 130 carries an airflow and includes an opening 150 to allow the airflow to pass therethrough. The opening 150 is in fluid communication with the toner cartridge 140 through an input port 160 of toner cartridge 140. The input port 160 is coupled to the opening 150 of the air duct 130. The opening 150 of the air duct 130 discharges the airflow into the input port 160 of the toner cartridge 140. The input port 160 directs the received airflow from the air duct 130 towards the developer roll 120 in order to reduce the temperature of the developer roll 120.

Normally, the airflow is generated by an air blower 170. The air blower 170 is in fluid communication with the air duct 130. The air blower 170 may take air in from outside of image forming device 100 and force airflow into the air duct 130 through an inlet 180 of the air duct 130. The air duct 130 may be disposed on an inside surface of a front cover 310 (see FIG. 3) of the image forming device 100. The front cover 310 may provide user access to an internal portion of the image forming device 100 in order to, for example, address media jams occurring in the media path of image forming device 100. The front cover 310 may swing in direction indicated by arrow A to move between an open and a closed position relative to a housing 300 (FIG. 3) of the image forming device 100. When the front cover 310 is in the closed position, the air duct 130 is in fluid communication with the toner cartridge 140. In the closed position, the opening 150 of the air duct 130 is coupled to the input port 160 of the toner cartridge 140. The coupling is provided through a sealing member 330 of air duct 130 associated with opening 150. The opening 150 of the air duct 130 then allows the airflow to pass to the input port 160. The input port 160 directs the received airflow towards and onto the surface of the developer roll 120. If there is more than one toner cartridge 140, the air duct 130 has more openings 150 to connect with the input ports of the other toner cartridges.

Figure 2:
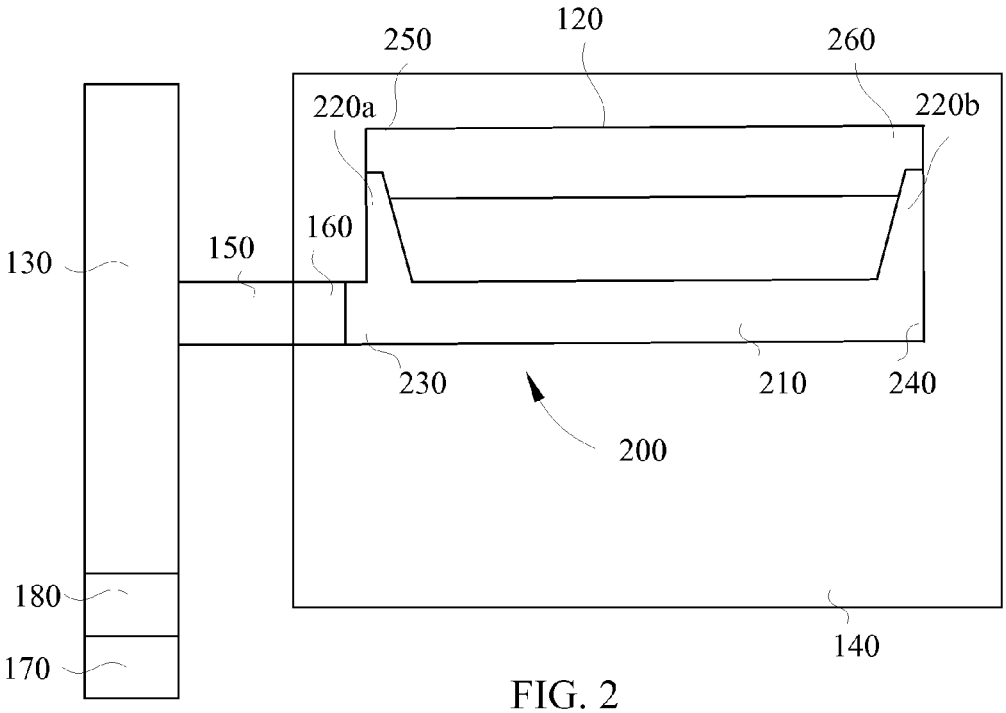
FIG. 2 is a schematic diagram of the air duct coupled to an air conduit positioned inside the toner cartridge of FIG. 1.

As illustrated in FIG. 2, the toner cartridge 140 includes an air conduit 200. The air conduit 200 is coupled to the input port 160 of the toner cartridge 140. The air conduit 200 receives the airflow from the input port 160. The air conduit 200 includes an elongated body 210 and a pair of nozzles 220*a*, 220*b*. The elongated body 210 has a length extending between a first end 230 and a second end 240. The first end 230 of the elongated body 210 is coupled to the input port 160 to receive the airflow. The elongated body 210 carries the received airflow and is in fluid communication with the pair of nozzles 220*a*, 220*b*. A nozzle 220 of the pair of nozzles 220*a*, 220*b* is disposed at each end of the elongated body 210. Nozzle 220*a* is positioned to direct the received airflow at a proximal end 250 of the developer roll 120 and the other nozzle 220*b* is positioned to direct the received airflow at a distal end 260 of the developer roll 120. However, it is understood the nozzles 220*a* and 220*b* may be positioned anywhere along the elongated body 210 as long as the nozzles 220*a* and 220*b* were generally directing the airflow at the developer roll 120. It is further understood that more than two nozzles 220 may be utilized for directing air towards developer roll 120.

Figure 3:
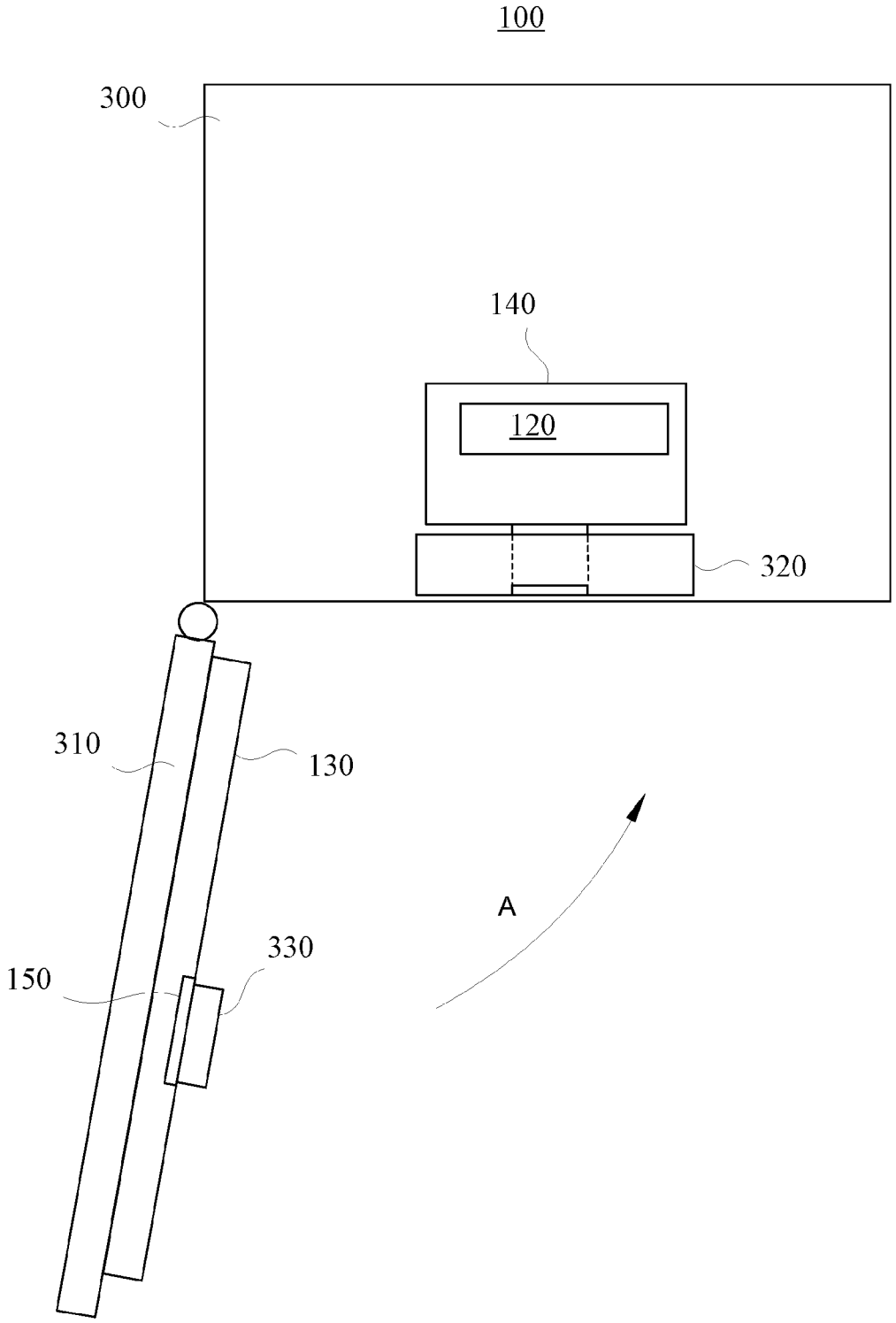
FIG. 3 is a top view of an image forming device in which the system of FIG. 1 is employed, including a waste toner box configured to connect the air duct to the toner cartridge.
Figure 4:
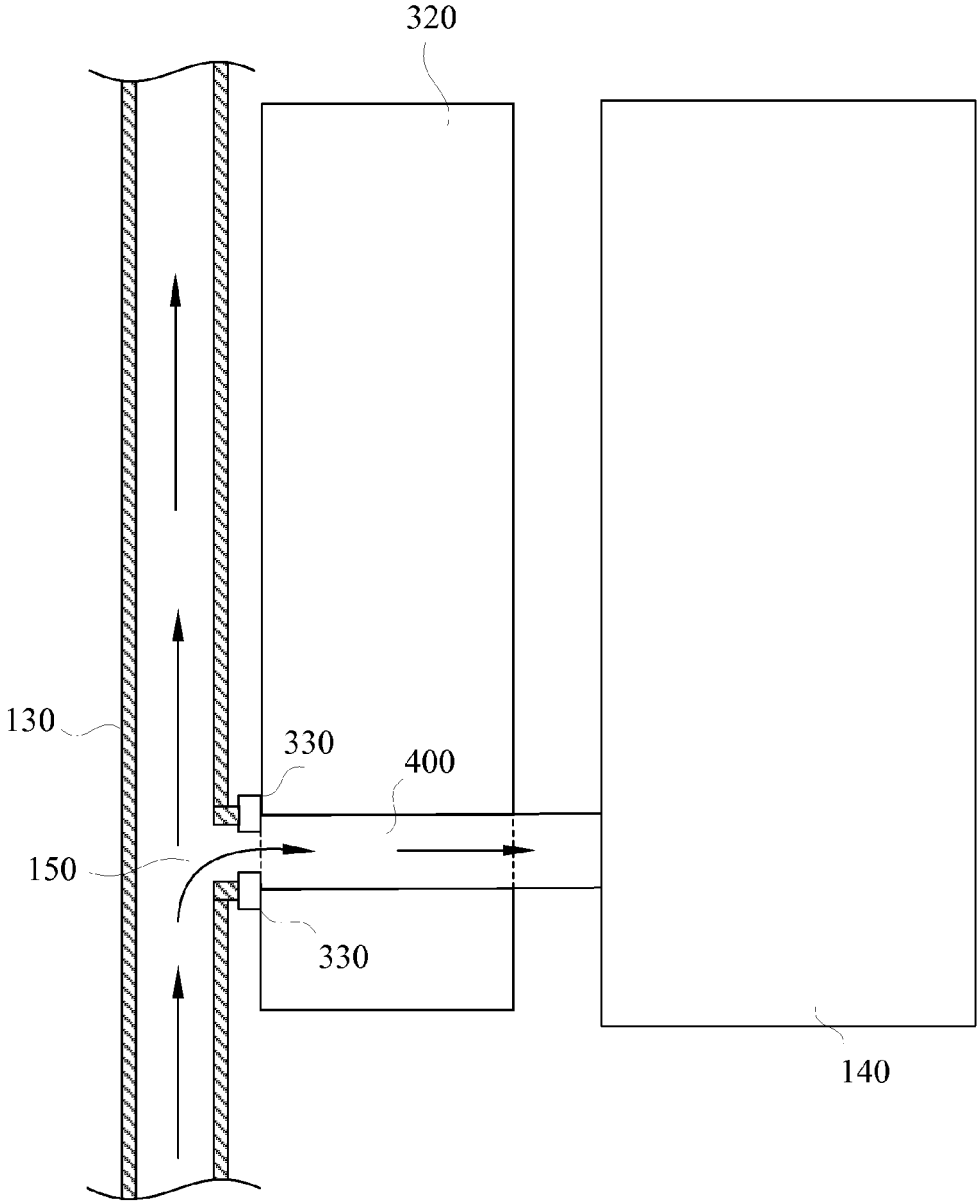
FIG. 4 is a partial cross section view of a channel included inside the waste toner box of FIG. 3 directing an airflow from the air duct to the toner cartridge.

As illustrated in FIGS. 3 and 4, the image forming device 100 includes a waste toner box 320. The waste toner box 320 is coupled to the toner cartridge 140. In an exemplary embodiment, the waste toner box 320 is positioned between the air duct 130 and the toner cartridge 140 due to space constraints in the image forming device 100. As a result, the waste toner box 320 may include a channel 400 (FIG. 4) to connect the air duct 130 to the toner cartridge 140 through the waste toner box 320. The channel 400 includes a first end and a second end such that when the front cover 310 is in the closed position relative to the housing 300, the opening 150 of the air duct 130 is coupled to the first end of the channel 400. The coupling of the opening 150 to the air duct 130 is provided through the sealing member 330. The channel 400 defines a first space in the waste toner box 320 that is isolated from a second space of the waste toner box 320 in which waste toner is collected.

Once the opening 150 is coupled to the first end of the channel 400, the first end of the channel 400 receives the airflow from air duct 130. The received airflow moves towards the second end of the channel 400. The second end of the channel 400 channels the airflow into the input port 160 of the toner cartridge 140. FIG. 4 illustrates the path of the airflow from the air duct 130 towards the toner cartridge 140 through the channel 400 provided inside the waste toner box 320. Once airflow passes into toner cartridge 140 from channel 400, it is directed towards developer roll 120, as described above with respect to FIG. 2.

It is understood that imaging device 100 may include additional components and modules not described hereinabove but which are commonly found in imaging devices including laser printers and multifunction imaging products. For example, imaging device 100 may include a print engine which cooperates with toner cartridge 140 to impart an image on a media sheet, a media feed mechanism for picking a sheet of media from an input media stack and forwarding the picked sheet to the print engine and subsequently to a media output tray, a user interface and a controller coupled to the print engine, the media feed mechanism and the user interface for controlling same (not shown).

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A cooling system for an imaging device comprising:

an air duct for carrying an airflow, the air duct having at least one opening to allow airflow to pass therethrough; and at least one toner cartridge in fluid communication with the air duct, the at least one toner cartridge including:

a developer roll; and a conduit having at least one input port coupled to the at least one opening of the air duct and at least one nozzle for directing airflow towards the developer roll;

wherein the at least one opening of the air duct is coupled to the at least one input port of the at least one toner cartridge through a sealing member.

2. The system of claim 1, further comprising an air blower in fluid communication with the air duct for forcing airflow therethrough.

3. The system of claim 1, wherein the imaging device includes a cover and the air duct is disposed along an inside surface of the cover.

4. The system of claim 1, further comprising a waste toner box positioned between the air duct and the at least one toner cartridge, wherein the waste toner box includes a channel connecting the at least one opening of the air duct to the at least one input port of the at least one toner cartridge.

5. The system of claim 4, wherein the channel includes a first end coupled to the opening of the air duct and a second end coupled to the at least one input port of the at least one toner cartridge, the channel defining a first space in the waste toner box that is isolated from a second space in which waste toner is collected.

6. The system of claim 1, wherein the conduit includes an elongated body having a length extending between a first end and a second end, the first end being coupled to the at least one input port for receiving the airflow, and the at least one nozzle comprises a plurality of nozzles disposed along the elongated body, a first of the nozzles positioned to direct the received airflow at a distal end portion of the developer roll and a second of the nozzles positioned to direct the received airflow at a proximal end portion of the developer roll.

7. The system of claim 1, wherein the imaging device includes a component positioned between the air duct and the at least one toner cartridge, the system further comprising a channel defined in the component for connecting the at least one opening of the air duct to the at least one input port of the at least one toner cartridge.

8. The system of claim 1, wherein the sealing member is disposed at the at least one opening of the air duct.

9. An imaging device comprising:

a housing;

an air duct disposed within the housing for carrying an airflow, the air duct having at least one opening to allow airflow to pass therethrough; and at least one toner cartridge disposed within the housing and in fluid communication with the air duct, the at least one toner cartridge including:

a roll member; and at least one input port coupled to the at least one opening of the air duct to receive the airflow and to direct the received airflow towards the roll member; and a waste toner box positioned between the air duct and the at least one toner cartridge, wherein the waste toner box includes a channel connecting the at least one opening of the air duct to the at least one input port of the at least one toner cartridge;

wherein the channel includes a first end coupled to the at least one opening of the air duct and a second end coupled to the at least one input port of the at least one toner cartridge, and wherein the coupling is provided through a sealing member.

10. The imaging device of claim 9, further comprising an air blower in fluid communication with the air duct for forcing airflow therethrough.

11. The imaging device of claim 9, further comprising a cover coupled to the housing for providing user access to an internal space within the housing, wherein the air duct is disposed along an inside surface of the cover.

12. The imaging device of claim 11, wherein the cover is movable between open and closed positions and the air duct is in fluid communication with the at least one toner cartridge when the cover is in the closed position and out of fluid communication when the cover is in the open position.

13. The imaging device of claim 9, wherein the toner cartridge further comprises an air conduit, the air conduit including:

an elongated body having a length extending between a first end and a second end, the first end being coupled to the at least one input port for receiving the airflow; and a plurality of nozzles disposed along the elongated body, a first of the nozzles positioned to direct the received airflow at a distal end portion of the roll member and a second of the nozzles positioned to direct the received airflow at a proximal end portion of the roll member.

14. The imaging device of claim 9, further comprising a component member positioned between the air duct and the at least one toner cartridge, wherein the component member includes a channel connecting the at least one opening of the air duct to the at least one input port of the at least one toner cartridge.

15. The imaging device of claim 9, wherein the sealing member is disposed at the at least one opening of the air duct.

* * * * *